US006926027B1

(12) United States Patent
Sorensen

(10) Patent No.: US 6,926,027 B1
(45) Date of Patent: Aug. 9, 2005

(54) FLUID HOSE-SUPPORTING SYSTEM FOR TRUCK

(76) Inventor: Carl L. Sorensen, 6911 Crystal Point Dr., Katy, TX (US) 77449

( * ) Notice: Subject to any disclaimer, the term of this patent is extended or adjusted under 35 U.S.C. 154(b) by 77 days.

(21) Appl. No.: 10/945,570

(22) Filed: Sep. 21, 2004

(51) Int. Cl.[7] ..... B65H 75/34

(52) U.S. Cl. ..... 137/355.12; 137/355.23; 137/355.26; 137/351; 137/899

(58) Field of Search ..... 137/355.12, 355.23, 137/355.26, 351, 899

(56) References Cited

U.S. PATENT DOCUMENTS 507,019 A 10/1893 Lucia
1,768,078 A 6/1930 Krause et al.
3,314,562 A * 4/1967 Farmer ..... 414/627
3,709,252 A * 1/1973 Bishop ..... 137/355.17
3,782,409 A * 1/1974 House et al. ..... 137/355.17
3,807,437 A * 4/1974 Lentel ..... 137/355.12
3,827,650 A 8/1974 Stevens et al.
4,446,884 A 5/1984 Rader, Jr.
4,487,218 A * 12/1984 Sifri ..... 137/355.26
4,732,345 A 3/1988 Golden
4,838,302 A * 6/1989 Prange ..... 137/355.12
4,944,258 A * 7/1990 Knutson et al. ..... 134/167 C
5,139,751 A * 8/1992 Mansfield et al. ..... 422/292
5,732,733 A 3/1998 Negus et al.

* cited by examiner

*Primary Examiner*—A. Michael Chambers
(74) *Attorney, Agent, or Firm*—Donald R. Schoonover

(57) ABSTRACT

Fluid hoses associated with land vehicles, such as a truck, are supported on the vehicle by a spring-biased reel mounted beneath the truck. Desired tension is maintained on the hoses by the spring loading of the reel whereby the hoses are maintained in a desired location and position on the vehicle.

1 Claim, 2 Drawing Sheets

FLUID HOSE-SUPPORTING SYSTEM FOR TRUCK

BACKGROUND OF THE INVENTION

1. Field of the Invention

The present invention relates to the general art of land vehicles, and to the particular field of accessories for land vehicles.

2. Description of the Related Art

Trucking is a huge industry and there are millions of trucks on the roads at any given time. Trucks are used to transport all manner of goods and are an integral link in the supply chain for nearly all goods.

Trucks, especially large trucks, generally have various systems, such as the brake system, that include some form of fluid-operated element. Fluids are supplied to such elements via fluid lines that extend from some sort of reservoir or control system to the element. Such fluid lines are often located beneath the truck or some part of the truck. As such, these lines are exposed to the roadway and may be damaged if they contact the roadway or with debris that may be present on the roadway and which can be driven up into the air when the truck passes over the debris. Ice is one source of such debris.

Therefore, there is a need for a means for maintaining fluid lines on a truck in a position that is as safe as possible from exposure to a roadway or to debris on that roadway.

Presently, such fluid lines are stored on trucks by means which include springs to hold the fluid lines taut. However, these spring-loaded mechanisms may become damaged or loose over time. As such, the fluid line can sag and become exposed to the dangers discussed above.

Therefore, there is a need for a means for maintaining fluid lines on a truck in a position which is as safe as possible from exposure to a roadway or to debris on that roadway and which is not likely to lose its ability to maintain the fluid hose in a safe location.

Still further, presently known means may be difficult to check to determine if the means is still functioning in an adequate manner. Even if degradation in performance of the means is known, it may be difficult to correct the problem because of the location of the hose support systems.

Therefore, there is a need for a means for maintaining fluid lines on a truck in a position that is as safe as possible from exposure to a roadway or to debris on that roadway which is not likely to lose its ability to maintain the fluid hose in a safe location and is easy to monitor and maintain.

In some instances, due to environmental conditions, age, or the like, some fluid hoses on trucks tend to change shape or length. If the hose is secured in position, such shape change may damage the hose or degrade its performance.

Therefore, there is a need for a means for maintaining fluid lines on a truck in a position that is as safe as possible from exposure to a roadway or to debris on that roadway which is not likely to lose its ability to maintain the fluid hose in a safe location and is easy to monitor and maintain and which will permit the hose to function efficiently even if the hose changes shape or size.

Some trucks have a sliding axle system and such systems may place tension on hoses associated with elements mounted on the sliding axle.

Therefore, there is a need for a means for maintaining fluid lines on a sliding axle vehicle in a desired position and at a desired tension.

PRINCIPAL OBJECTS OF THE INVENTION

It is a main object of the present invention to provide a means for maintaining fluid lines on a truck in a position that is as safe as possible from exposure to a roadway or to debris on that roadway.

It is another object of the present invention to provide a means for maintaining fluid lines on a truck in a position that is as safe as possible from exposure to a roadway or to debris on that roadway which is not likely to lose its ability to maintain the fluid hose in a safe location.

It is another object of the present invention to provide a means for maintaining fluid lines on a truck in a position that is as safe as possible from exposure to a roadway or to debris on that roadway which is not likely to lose its ability to maintain the fluid hose in a safe location and is easy to monitor and maintain.

It is another object of the present invention to provide a means for maintaining fluid lines on a truck in a position that is as safe as possible from exposure to a roadway or to debris on that roadway which is not likely to lose its ability to maintain the fluid hose in a safe location and is easy to monitor and maintain and which will permit the hose to function efficiently even if the hose changes shape or size.

It is another object of the present invention to provide a means for maintaining fluid lines on a sliding axle vehicle in a desired position and at a desired tension.

SUMMARY OF THE INVENTION

These, and other, objects are achieved by a hose storage system that includes a spring-biased hose reel on which a fluid line hose is stored on a land vehicle. The spring-biased hose reel is located beneath the vehicle and maintains a desired amount of tension on the hoses, even if conditions change.

Using the hose storage system embodying the present invention will permit fluid line hoses on a land vehicle, such as a truck, including a sliding axle truck, to be maintained in a desired location and at a desired tension. The hoses and the reel are easily inspected and serviced if necessary.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a fluid hose-supporting system 10 for use on a land vehicle, such as a truck 12 and which maintains the fluid hose in a desired location and position on the vehicle.

Figure 3:
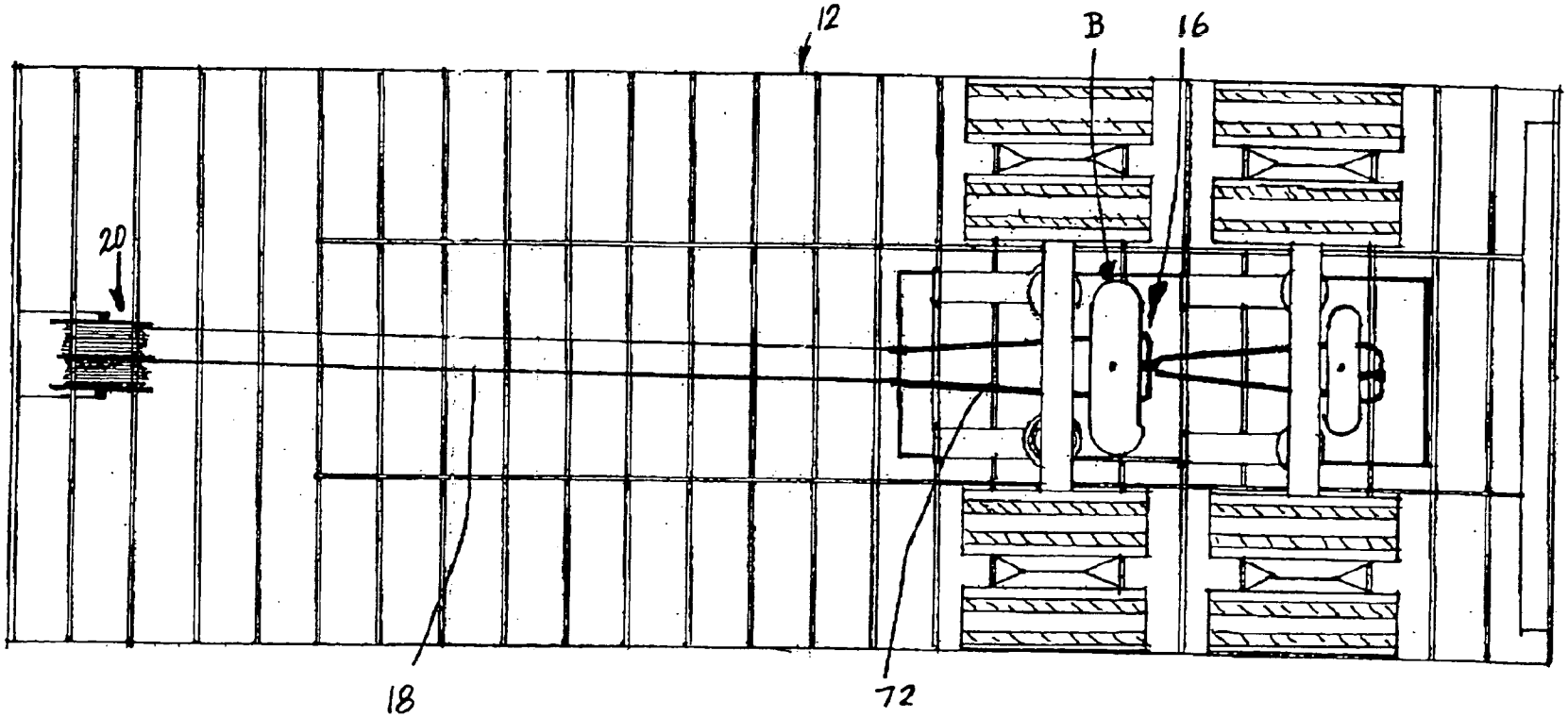
FIG. 3 is a bottom view of the truck trailer shown in FIG. 1.

System 10 comprises land vehicle 12 having a first surface 14 that is a bottom surface when land vehicle is in use 12. Vehicle 12 includes a hydraulic system 16, such as a brake system for wheels W, or the like, which includes at least one fluid hose 18. As can be understood from FIG. 3, multiple hoses can be included in the fluid system if suitable.

Figure 1:
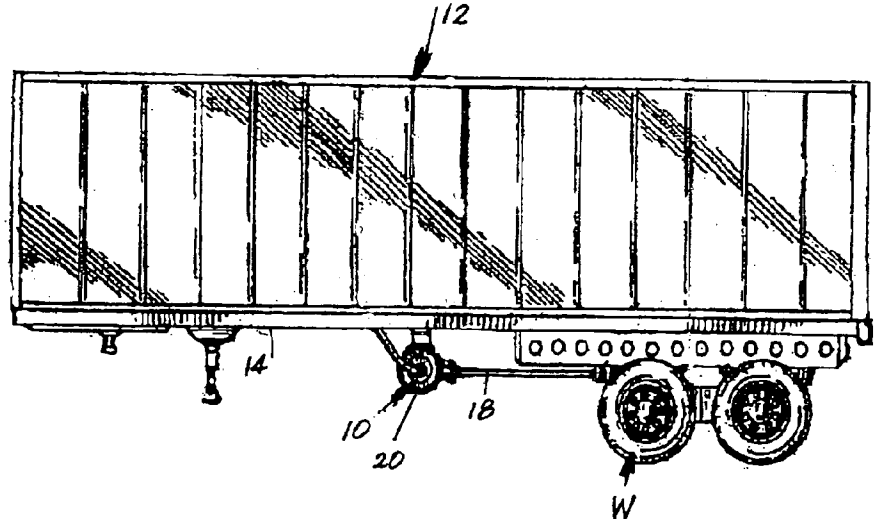
FIG. 1 is a side elevational view of a truck trailer having a hose-supporting system embodying the present invention.
Figure 2:
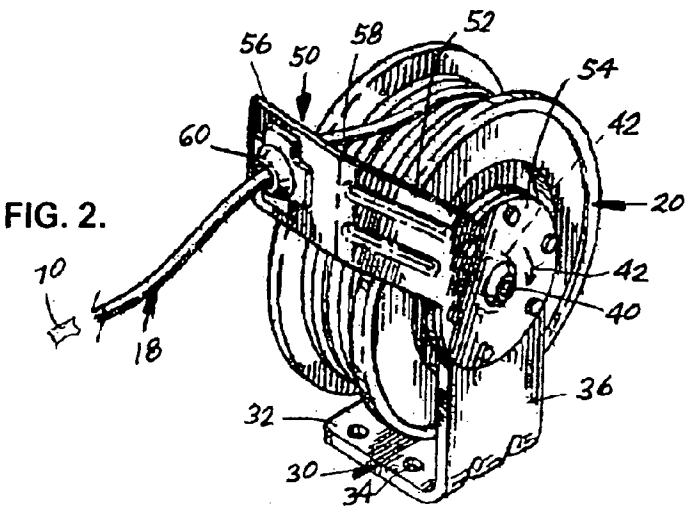
FIG. 2 is a perspective view of a hose reel which is included in the hose-supporting system embodying the present invention.

A spring-loaded reel 20 is mounted on first surface 14 and is wound around reel 20 as can be understood from FIGS. 1 and 2.

Reel 20 includes an L-shaped mounting bracket 30 having a first portion 32 that is mounted on land vehicle 12, such as by mounting bolts that extend through bolt-accommodating holes 34, when reel 20 is in use as shown in FIG. 1, and a second portion 36 that extends downwardly from first surface 14 when reel 20 is in use.

An axle 40 is rotatably mounted on second portion 36 of the mounting bracket 30 to extend parallel to first surface 14 of the land vehicle when reel 20 is mounted on the land vehicle. A spring 42 is connected at one end thereof to the axle 40 and at a second end thereof to the mounting bracket 30 and biases the axle 40 to rotate in one direction as indicated by arrow 44 in FIG. 2. It is noted that the spring-biasing mechanism for reel 20 is similar to those shown in the prior art, such as U.S. Pat. Nos. 3,806,671, 4,010,913 and 5,230,481, the disclosures of which are incorporated herein by reference. Those skilled in the art will understand which elements are used and how such elements are connected together to bias hose 18 in a hose-tightening direction based on the teaching of the present disclosure.

A hose guide element 50 is mounted on bracket 30 and includes a first arm 52 pivotally mounted at a first end 54 thereof on second portion 36 of the mounting bracket 30, and a second arm 56 mounted on second end 58 of first arm 52. Second arm 56 extends parallel to axle 40 and includes a hose-guiding hole 60 defined therethrough.

A fluid hose, such as fluid hose 18, is connected at a first end 70 thereof to a fluid system on the land vehicle and is connected at a second end 72 thereof to a fluid-operated element, such as a brake system B of the land vehicle. The fluid hose is wound around the axle 40 of the reel 20 and extends through hose-guiding hole 60 of the reel 20.

As can be understood from the foregoing, the fluid hose will be maintained subjacent to the bottom of the vehicle yet will be able to move as necessary. Proper tension will be maintained on the fluid hose by spring-biased reel 20 and the hose will be easily moved as needed to maintain proper conditions for the hose no matter what system the hose is associated with and no matter what conditions are associated with the hose.

It is understood that while certain forms of the present invention have been illustrated and described herein, it is not to be limited to the specific forms or arrangements of parts described and shown.

What is needed and desired to be covered by Letters Patent is as follows:

1. A fluid hose supporting system for use on a truck comprising:

(a) a land vehicle having a first surface that is a bottom surface when said land vehicle is in use and a hydraulic system which includes at least one fluid hose;

(b) a spring-loaded reel mounted on the first surface of said land vehicle, the fluid hose being wound around said reel, said reel including (1) an L-shaped mounting bracket having a first portion that is mounted on said land vehicle when said reel is in use and a second portion that extends downwardly from the first surface when said reel is in use, (2) an axle rotatably mounted on the second portion of the mounting bracket to extend parallel to the first surface of said land vehicle when said reel is mounted on said land vehicle, (3) a spring connected at a first end thereof to the axle and at a second end thereof to the mounting bracket and biasing the axle to rotate in one direction, (4) a hose guide element mounted on the bracket and including (A) a first arm pivotally mounted at a first end thereof on the second portion of the mounting bracket, and (B) a second arm mounted on a second end of the first arm, the second arm extending parallel to the axle and including a hose-guiding hole defined therethrough; and (c) a fluid hose connected at a first end thereof to a fluid system on said land vehicle and connected at a second end thereof to a fluid-operated element on said land vehicle, said fluid hose being wound around the axle of said reel and extending through the hose-guiding hole of said reel.

* * * * *